United States Patent [19]

Saunders

[11] 3,937,047

[45] Feb. 10, 1976

[54] STRUCTURE AND METHOD FACILITATING STRIPPING OF SEAMLESS CAN BODY FROM IRONING MANDREL

[75] Inventor: William T. Saunders, Weirton, W. Va.

[73] Assignee: National Steel Corporation, Pittsburgh, Pa.

[22] Filed: Mar. 17, 1975

[21] Appl. No.: 559,056

[52] U.S. Cl. ..... 72/344; 72/208; 72/349

[51] Int. Cl.[2] ..... B21D 45/00

[58] Field of Search ..... 72/344, 345, 347, 349, 72/208

[56] References Cited

UNITED STATES PATENTS

| | | | |
|---|---|---|---|
| 2,397,544 | 4/1946 | Garand | 72/208 |
| 2,412,813 | 12/1946 | Keller | 72/349 |

*Primary Examiner*—Lowell A. Larson

*Attorney, Agent, or Firm*—Shanley, O'Neil and Baker

[57] ABSTRACT

In the manufacture of drawn and ironed, unitary, can bodies, structure and method which interrupt surface contact between an ironing mandrel and the interior sidewall of a can body being ironed to reduce friction for removal of the ironed can body from the mandrel.

During passage through an ironing ring, sidewall metal is moved into a narrow-width, linearly-extended indentation in the mandrel sidewall. The metal of the protrusion thus formed on the interior surface of the can body is moved along the mandrel sidewall during passage through a subsequent ironing ring, with such movement breaking surface adhesion between the mandrel sidewall and the interior surface of the container body sidewall to facilitate removal.

8 Claims, 6 Drawing Figures

Figure 3:
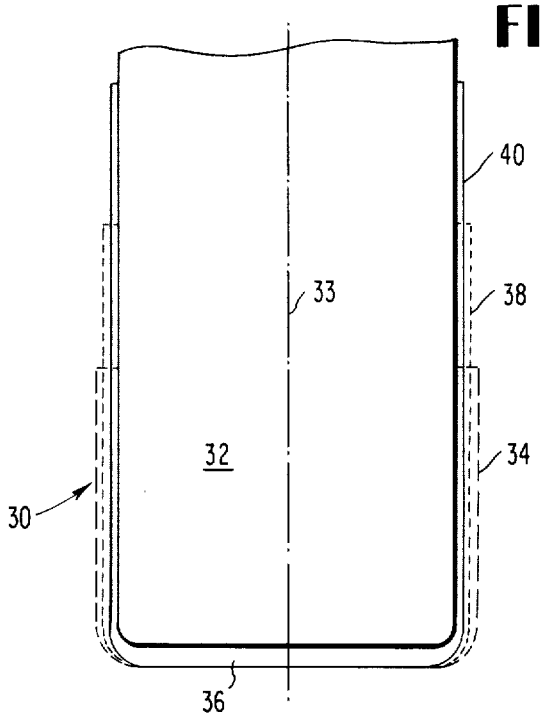

FIG. 1
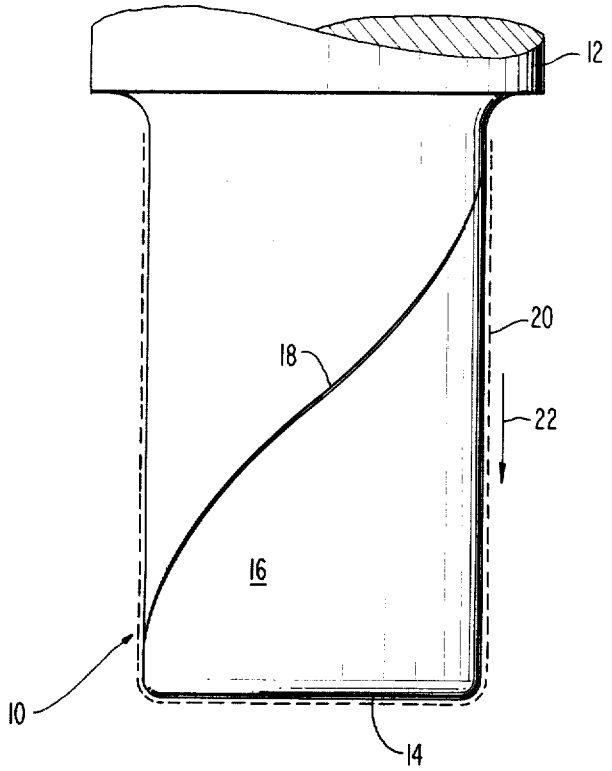
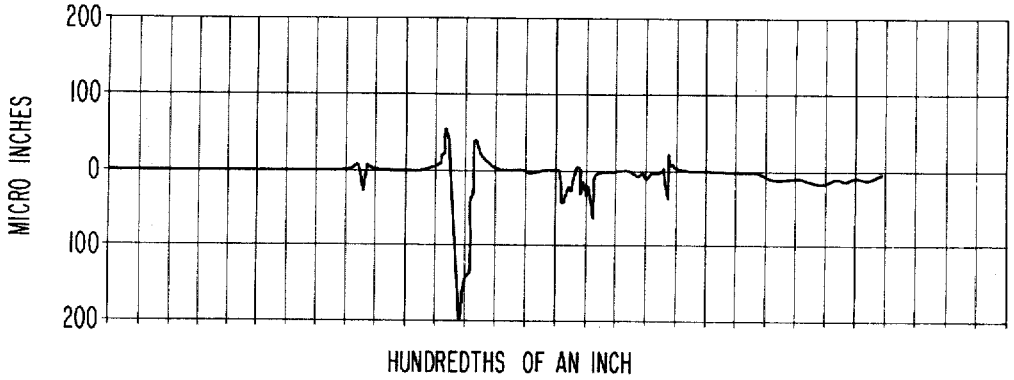
FIG. 2

STRUCTURE AND METHOD FACILITATING STRIPPING OF SEAMLESS CAN BODY FROM IRONING MANDREL

The invention is concerned with improving the manufacture of drawn and ironed seamless container bodies; more specifically, improved methods and structures for facilitating stripping of a drawn and ironed seamless container body from a mandrel after an ironing operation.

In the manufacture of seamless container bodies, a sheet metal blank is formed into a cup shape with a bottom wall and unitary sidewall. The sidewall is then thinned and elongated during passage successively through a series of ironing rings. Both the drawing and the ironing can be carried out in a single stroke of a mandrel having a common longitudinal central axis with the ironing rings. Basic machinery for ironing of sheet metal container sidewalls has been known in the art. Further details of such machinery and the theory of drawing and ironing are available in the literature; e.g. see U.S. Pats. No. 3,203,218 and 3,670,543.

Because of the intimate surface contact formed between the mandrel and the container, the problem of removing a container body from a mandrel after ironing has been a major concern. U.S. Pat. No. 3,406,554 discloses apparatus and methods for forming a gap for the reception of a flanging and stripping mechanism to facilitate removal. U.S. Pat. No. 3,733,880 discusses methods and means for applying radially directed forces for flattening portions of the can body to facilitate subsequent stripping from a punch.

The complexity of such approaches of the prior art contrasts sharply with the simplified approach and the satisfactory solution contributed by the present invention.

During ironing a punch-mounted cup-shaped article is forced through a female ironing ring of circular configuration. The ironing ring is concentric with the ironing mandrel and has an internal diameter slightly less than that of the mounted cup-shaped article but also slightly greater than the external diameter of the peripheral working surface of the mandrel. As the metal is worked, an intimate surface contact is established between such mandrel sidewall working surface and the interior sidewall of the container body. This intimate surface contact manifests itself as an undesirably tight adherence between the mandrel and the cup-shaped article which makes stripping difficult.

In ironing steel container bodies, that approach which involves polishing the mandrel peripheral working surface to a high luster further increases such intimate surface contact between the smooth surface of the mandrel sidewalk and the smooth surface developed on the interior of the can body sidewall during ironing. The present invention takes a different approach.

The present invention modifies such intimate contact without distortion of the cylindrical configuration can body and without adding complexity or machinery. This interruption of friction contact between the mandrel and the container is performed as part of the ironing operation.

Figure 4:
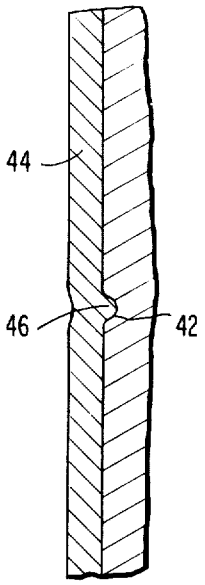
Figure 5:
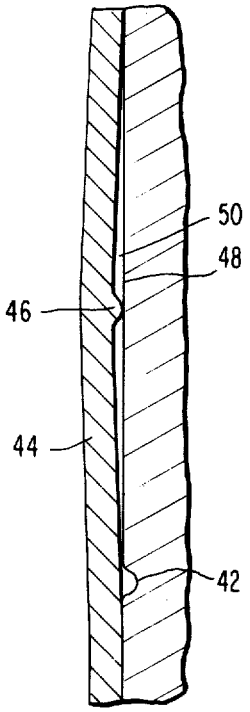
Figure 6:
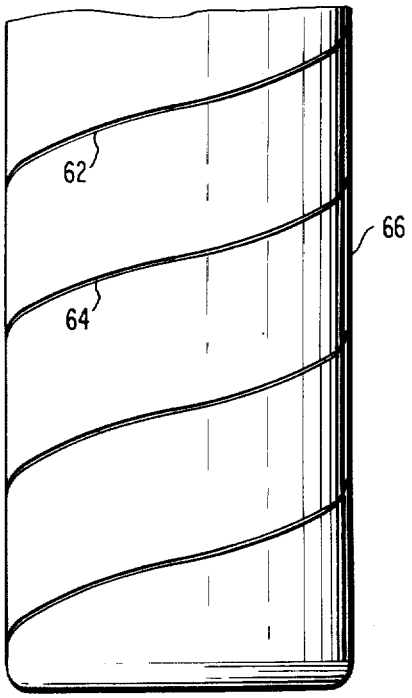

Referring to the accompanying drawings for further description of the invention:

FIG. 1 is a side elevational view of a mandrel embodying the present invention and includes a schematic cross-sectional view of a cup-shaped article shown in dotted lines, FIG. 2 is a graphical representation of a measured surface characteristic of the sidewall of the mandrel of FIG. 1, FIG. 3 is a schematic representation of sidewall sheet metal movement caused by successive passage of a cup-shaped article through a plurality of ironing rings, FIG. 4 is a schematic representation of an enlarged cross-sectional portion of a surface of a mandrel embodying the invention and the adjoining sheet metal of the cup-shaped article mounted on that mandrel after passage through a first ironing ring, FIG. 5 is an enlarged cross-sectional view of portions of the mandrel surface and cup-shaped article surface of FIG. 4 showing movement of the sheet metal during passage through a subsequent ironing ring, and FIG. 6 is a side elevational view of a mandrel embodying the invention employing a plurality of helical indentations.

Referring to FIG. 1, elongated mandrel 10 includes work input end 12 and work output end 14 joined by a sidewall 16. The working surface of the mandrel sidewall 16 includes indention means and surrounding peripheral surface; the latter being uniformly spaced from the central longitudinal axis of the mandrel 10.

In accordance with the invention a linearly-extended, narrow-width indentation 18 extends both longitudinally along and circumferentially about the mandrel sidewall over its working surface. Indentation 18 takes the form of a helix extending over substantially the full working surface between the longitudinal ends of the mandrel.

A plurality of helices can also be used. Such open face grooves or indentation lines interrupt the surface bonding effect between the mandrel and container sidewall which normally occurs during passage through an ironing ring by breaking the continuous intimate contact of the ironed container sidewall with the mandrel experienced in conventional ironing.

Indentation 18, or other suitably directed indention means, are formed in the mandrel sidewall 16 with a cross-sectional configuration allowing movement of metal into and out of such indentation during passage through successive ironing rings.

Typical dimensions for a satisfactorily performing indention are shown in FIG. 2. This magnified surface representation of a portion of a sidewall of a mandrel is referred to as a "TALYSURF" reading and is performed by a "TALYSURF" indicator, manufactured by and available through Engis Equipment Company, Morton Grove, Illinois. This instrument provides a highly accurate representation of surface conditions. For example, in the representation, vertical impressions are magnified 5,000 times and the horizontal impressions are magnified 20 times. As indicated in FIG. 2, the vertical measurements are in microinches and the horizontal measurements are in hundredths of an inch. This graphical representation was taken across the surface indentation 18 of FIG. 1. As indicated by the reading, groove 18 is about 200 micro-inches in depth and has a width at its open end of about 0.01 inches, which is typical for 12-oz. beverage can mandrel. The remaining peripheral surface is, practically speaking, smooth; i.e. substantially uniformly spaced from the central longitudinal axis of the mandrel 10.

The surface indentation means can be formed on the cylindrical periphery of the mandrel in various ways, e.g. by machining mechanically or chemically; also, the surface indentation means can be other than helical. However interruption in the intimate, high-friction, surface contact between the interior surface of the container wall and the peripheral surface of the mandrel preferably takes place around the full circumference and along substantially the full working surface length between longitudinal ends of the mandrel.

FIG. 3 shows movement of the sidewall metal of the cup-shaped article during ironing. A cup-shaped article 30 is mounted on mandrel 32. Article 30 can be drawn into cup shape on mandrel 32. The sidewall 34 of the originally drawn cup 30 is shown in dotted lines. The thickness of the sidewall 34 and the thickness of the bottom wall 36 of the drawn cup 30 are approximately the same and have a thickness gage which is well known or readily available to those skilled in the art. for flat rolled steel or aluminum. Such thickness gage can vary dependent on can size, end usage for the container, and strength requirements.

Mandrel 32 and cup-shaped article 30 are moved longitudinally in a direction parallel to the central longitudinal axis 33 of mandrel 32. The mandrel and mounted cup are forced through female circular ironing dies (not shown) which are positioned concentric with the mandrel; i.e. having interior working surfaces uniformly spaced radially from the central longitudinal axis 33. The internal diameter of the first ironing ring is slightly smaller than the external diameter of the sidewall of cup 30. Each succeeding ironing ring is of slightly smaller diameter than the preceding. Of course, the internal diameter of all such ironing rings is larger than the external diameter of mandrel 32.

During passage through a first ironing ring sidewall 34 is elongated and thinned forming intermediate sidewall 38 (shown in dotted lines). During passage through the next successive ironing ring, which is of slightly smaller diameter than that of the previous ironing ring, the sidewall sheet metal is again thinned and moved upwardly along the mandrel 32 forming sidewall 40 of the container body.

This movement of sheet metal along the mandrel sidewall by passage through successive rings is used to interrupt and reduce intimate surface contact between the mandrel and the mounted container body. FIGS. 4 and 5 are attempts to show schematically the interruption in intimate surface contact phenomenon deemed to occur within the container body as the container sidewall metal is moved longitudinally during passage through successive ironing rings. In FIG. 4, the enlarged view of the cylindrical peripheral surface of the mandrel shows indentation 42 in radial cross section. During passage through the first ironing ring sheet metal of sidewall 44 is moved into indentation 42 forming the protrusion 46.

During passage through a successive ironing ring, protrusion 46 is moved out of its initial location in indentation 42 or replaced by other metal. The metal of protrusion 46 is moved or tends to move into contact with peripheral surface 48, which is indention free. In the theory of the operation which facilitates removal, this protrusion metal movement raises sidewall sheet metal slightly from such smooth peripheral surface 48, thus breaking the intimate surface contact in a manner shown in exaggerated form at space 50. This metal movement process is repeated during passage through successive ironing rings with a protrusion on the interior surface of the container body sidewall being formed in an indentation on the mandrel and, such protrusion metal being moved along the surface of the mandrel, or replaced by other sheet metal, reducing intimate surface contact between the ironing mandrel and the container sidewall to reduce friction facilitating removal after ironing.

While such protrusion is substantially flattened during such subsequent ironing, the tight adherence of mandrel and container of the prior art has been broken and is not fully re-established during passage through such subsequent ironing ring. This action is sufficient to allow easy removal of the container body after ironing and yet does not change the configuration of, nor mar the interior surface of, a container body in a manner which would inhibit any normal use of the container body. Examination, using magnification, of the interior surface of a container body after passage through a plurality of rings and removal from the mandrel, may reveal a faint impression of a wavy line, extending along the interior surface of the container body following the path of the indentation; e.g. helical with an indentation such as 18 of mandrel 10. The minute protrusion of sheet metal formed in an indentation, while being sufficient to break surface friction, is evidentally smoothed out by stripping of the container body from the mandrel.

Typical starting gages for flat rolled steel in forming drawn cup 30 would be between about 0.011 inch to about 0.015 inch (about 0.25mm to about 0.4mm) in manufacturing container bodies for conventional pressurized beverage cans, and the like. That thickness gage is maintained in bottom wall 36 during ironing while the sidewall is reduced in thickness; e.g. the flat rolled steel of sidewall 40 would be reduced to a thickness gage in the range of about 0.003 inch about 0.005 inch (about 0.08mm to about 0.125mm). Starting gages for an aluminum cup would be between about 0.014 inch and 0.021 inch (about 0.35mm to 0.55mm) and would be ironed to about 0.005 inch to 0.010 inch (about 0.13mm to 0.25mm)

FIG. 6 shows a plurality of helical lines 62 and 64 extending along the surface of mandrel 66. These indentations can follow a screw thread path or can have other configurations in travelling around a mandrel and extending longitudinally over its working surface.

Modifications in methods of forming these indentations in their linearly extended configurations and in dimensional and operational aspects will be available to those skilled in the art from the present disclosure without departing from the inventive teachings, therefore the scope of the invention is to be determined from the appended claims.

What is claimed is:

1. Structure for use in an ironing process in which the sidewall sheet metal of a seamless, unitary, cup-shaped article is reduced in thickness and elongated by passage of the cup-shaped article, while mounted on a mandrel through a plurality of female, circular, ironing rings of progressively smaller internal diameter, during which passage an intimate surface contact is normally established causing an undesirably tight adherence between the elongated sidewall of the cup-shaped article and the punch, such structure facilitating removal of an ironed sidewall cup-shaped article from the mandrel after ironing comprising an elongated, generally-cylindrical configuration ironing mandrel having a work input end, a central longitudinal axis, a sidewall radially spaced from the central longitudinal axis, and a work output end longitudinally opposite to the work input end, the mandrel sidewall including indention means and remaining peripheral surface means, the latter being uniformly spaced radially from the central longitudinal axis of the mandrel, the indention means comprising a narrow-width, linearly-extended indentation subsurface of the remaining peripheral surface of the mandrel sidewall which is uniformly spaced radially from the central longitudinal axis, such indentation extending over a major portion of the mandrel sidewall which is contacted by sheet metal of the cup-shaped article sidewall providing for movement of sidewall sheet metal into such indentation to form a protrusion on the interior surface of the sidewall of the cup-shaped article during passage through an ironing ring and for movement of such protrusion metal along the sidewall of the mandrel during passage through a subsequent ironing ring so as to reduce intimate surface contact between the interior surface of the cup-shaped article and the ironing mandrel to facilitate removal of such cup-shaped article after ironing.

2. The structure of claim 1 in which the indentation has a depth of about 200 micro-inches below the remaining peripheral surface of the mandrel sidewall.

3. The structure of claim 1 in which the cross-sectional width of such indentation is approximately 0.01 inch.

4. The structure of claim 1 including a plurality of narrow-width, linearly-extended indentations in the cylindrical peripheral surface of the mandrel.

5. The structure of claim 1 in which the linearly-extended, narrow-width indentation defines a helix extending over substantially the full length of such peripheral working surface of the mandrel sidewall.

6. The structure of claim 2 in which such helical indentation extend around the full circumference of the cylindrical mandrel.

7. The structure of claim 6 in which such helical indentation extends a distance in excess of a full circumference of the cylindrical mandrel within that position of the peripheral surface of the mandrel contacted by sidewall sheet metal of the cup-shaped article.

8. Method for elongating and thinning the sidewall of a seamless, unitary, sheet metal cup-shaped article and facilitating stripping of such elongated sidewall cup-shaped article from an ironing mandrel by modifying the intimate surface contact between article and mandrel normally established during ironing, comprising the steps of providing an elongated, generally-cylindrical configuration ironing mandrel having a work input end, a central longitudinal axis, a sidewall radially spaced from the central longitudinal axis, and a work output end longitudinally opposite to the work input end, the mandrel sidewall including indention means and peripheral surface means, the latter being uniformly spaced radially from the central longitudinal axis, the indention means comprising a narrow-width, linearly-extended, indentation, which indentation extends over a major portion of that portion of the mandrel sidewall contacted by sidewall sheet metal of a cup-shaped article being ironed, providing a sheet metal cup-shaped article mounted on such mandrel, the cup-shaped article having a bottom wall, unitary sidewall, and an open end longitudinally opposite to such bottom wall, the cup-shaped article having a configuration conforming to that of the ironing mandrel, moving the mandrel and mounted cup-shaped article through a first, female, circular ironing ring having a central axis coincident with that of the central longitudinal axis of the ironing mandrel, such ironing ring having an internal diameter less than the external diameter of the cup-shaped article and greater than that of the peripheral surface of the ironing mandrel such that sidewall sheet metal of the cup-shaped article is elongated and thinned with sidewall sheet metal being moved into at least a portion of such indentation forming a protrusion in the sheet metal on the interior surface of the cup-shaped article sidewall, continuing longitudinal movement of the ironing mandrel and mounted cup-shaped article through a subsequent ironing ring of smaller internal diameter than the first ironing ring so as to move the sheet metal of the cup-shaped article sidewall longitudinally further along the sidewall of the mandrel, including movement of such protrusion metal, formed on the interior surface of the cup-shaped article sidewall, along the mandrel sidewall into contact with the peripheral surface of the mandrel reducing frictional contact between the peripheral surface of the mandrel sidewall and the interior surface of the cup-shaped article to facilitate removal of such cup-shaped article from such mandrel after ironing.

* * * * *

UNITED STATES PATENT OFFICE
CERTIFICATE OF CORRECTION

PATENT NO. : 3,937,047
DATED : February 10, 1976
INVENTOR(S) : WILLIAM T.SAUNDERS It is certified that error appears in the above-identified patent and that said Letters Patent are hereby corrected as shown below:

Column 1, line 55 - "sidewalk" should read -- sidewall --.

Column 4, line 35 - after ".003 inch" insert -- to --.

Column 4, line 40 - after "0.25mm)" add -- . --.

Column 5, line 43 - "claim 2" should read -- claim 5 --.

Column 5, line 48 - "position" should read -- portion --.

Signed and Sealed this

Thirty-first Day of August 1976

[SEAL]

*Attest:*

RUTH C. MASON
*Attesting Officer*

C. MARSHALL DANN
*Commissioner of Patents and Trademarks*